US006415570B1

(12) United States Patent
Wentz

(10) Patent No.: US 6,415,570 B1
(45) Date of Patent: Jul. 9, 2002

(54) MODULAR ROOFING SYSTEM AND ASSEMBLY

(75) Inventor: Joel L. Wentz, Hartford, WI (US)

(73) Assignee: Roofers Mart of Wisconsin, Inc., Wauwatosa, WI (US)

( * ) Notice: Subject to any disclaimer, the term of this patent is extended or adjusted under 35 U.S.C. 154(b) by 0 days.

(21) Appl. No.: 09/653,391

(22) Filed: Sep. 1, 2000

(51) Int. Cl.[7] ..... E04D 13/04

(52) U.S. Cl. ..... 52/302.1; 52/71; 52/90.2; 52/309.4; 52/309.8

(58) Field of Search ..... 52/302.1, 71, 90.2, 52/90.1, 309.4, 309.8, 309.1

(56) References Cited

U.S. PATENT DOCUMENTS 4,014,145 A * 3/1977 Groves ..... 52/199
5,966,883 A 10/1999 Krusec et al.
6,105,324 A * 8/2000 Krusec et al. ..... 52/302.1

OTHER PUBLICATIONS

Johns Manville, DiamondBack Distributor Price List (RS–5089).

Atlas Roofing Corporation, Gemini Pre–Cut Crickets Brochure, 1997 (2 pages)(ARC 1297–1187).

Johns Manville, DiamondBack OmniDiamond Standard Pre–Cut Crickets Brochure (RS–5084).

Johns Manville, DiamondBack OmniDiamond Standard Pre–Cut Crickets Brochure (RS–5081).

Johns Manville, DiamondBack OmniDiamond Standard Pre–Cut Crickets Brochure (RS–5083).

Atlas Roofing Corporation, Gemini Pre–Cut Crickets Brochure, Specifications and Prices.

Johns Manville DiamondBack Pre–Cut Choices, Product Family Brochure.

* cited by examiner

*Primary Examiner*—Carl D. Friedman
*Assistant Examiner*—Yvonne M. Horton
(74) *Attorney, Agent, or Firm*—Reinhart Boerner Van Deuren S.C.

(57) ABSTRACT

A modular drainage system and/or assembly for flat-roofed or low-slope roofed structures available without field fabrication.

28 Claims, 10 Drawing Sheets

MODULAR ROOFING SYSTEM AND ASSEMBLY

BACKGROUND OF INVENTION

The present invention pertains to drainage apparatus for flat-roofed or low-slope roofed structures, and particularly to kits, systems and/or assemblies used for such purposes.

The advent of flat roof building construction brought with it the problem of standing water. Standing water accelerates the aging process of any roofing construction and promotes early failure. Accordingly, considerable effort has been undertaken to reduce the incidence of standing water in conjunction with "low-slope roofing." For example, U.S. Pat. No. 4,014,145 discloses the use of roofing saddles to assist removal of standing water. As known in the art, a roofing saddle is a flat-bottomed pyramid which has an elongated diamond-shaped bottom and a central peak or vertex on its top surface. Four surfaces of the saddle sloping down from the central vertex allow water to run off the saddle for collection in drains strategically placed about the roofing surface. On large roof expanses, building designers often plan the structural portion of a roof deck as a series of pyramids to provide raised centers with valleys therebetween. A drain pipe can then be installed at the confluence of four valleys. However, as often happens, the valley between two structural pyramids would become a collection point for standing water. Roofing saddles in the valleys are installed to prevent the resulting damage. For many years, such drainage systems have been the preferred method of removing residual water from flat roofs.

Numerous attempts have been made to address the design and installation of a useful roofing saddle. Traditionally, roofing saddles have been prepared onsite by hand from low-cost fiber board, expanded polystyrene plastic foam or remnant construction site materials. This approach is time-consuming and labor intensive. The results are as one would expect using whatever materials are available, with little or no pre-conceived design or notion.

Increasingly, to reduce escalating labor costs, roofing contractors have turned to factory-made, pre-fabricated saddles. For instance, U.S. Pat. No. 5,966,883 describes a triangular panel unit for construction of a roofing saddle. Each triangular panel comprises hinged sections which can be foldably collapsed one on another for ease of storage and transport. Roofing saddles or portions thereof are formed using one or more sets of the panel units, with four such panels comprising a pyramidal roofing saddle.

However, several problems remain with the pre-fabricated approach. For example, factory-made roofing saddles have not proven more efficient. A long lead time for factory orders (e.g., eight weeks) is often required, but inconsistent with the fast-track building approach employed by many building system managers. As a result, construction delays continue at the price of higher labor costs and related cost over-runs.

Even so, such saddles are not wholly "pre-fabricated". For instance, with the aforementioned '883 patent, each panel unit of a roofing saddle must be "modified" on site. Modification is defined therein and described on packaging materials as cutting or trimming each panel unit, as necessary to provide four panel units meeting at a pyramidal vertex. Such modification necessarily introduces a margin of error. Discretionary trimming or cutting can result in defective installment. Often times, such panels and/or steps are simply omitted to save time or labor—at the risk of later water damage.

SUMMARY OF INVENTION

There are a considerable number of problems and deficiencies associated with roofing saddles and related apparatus, as previously constructed and/or prefabricated. There is a demonstrated need for roofing systems and/or assemblies providing good drainage function with easy, problem-free installation.

Accordingly, it is an object of the present invention to provide various roofing assemblies and/or kits which can be used as described herein, thereby overcoming various deficiencies and short-comings of the prior art, including those outlined above. It will be understood by those skilled in the art that one or more aspects of this invention can meet certain objectives, while one or more other aspects can meet certain other objectives. Each objective may not apply equally, in all instances, to every aspect of the present invention. As such, the following objects can be viewed in the alternative with respect to any one aspect of the present invention.

It can be an object of the present invention to provide a roofing kit and/or assembly which can be used without the effort and waste which accompany field fabrication.

It can also be an object of the present invention to provide a roofing system which affords a range of related structural alternatives to accommodate a variety of drain configurations.

It can also be an object of the present invention to provide a roofing assembly, system and/or kit with components configured to optimize manufacturing efficiency and minimize waste through the choice of the geometric relationships between such components.

It can also be an object of the present invention to increase rate of drainage flow through use of a roofing system or assembly which assures a minimum resultant slope.

Other objects, features, benefits and advantages of the present invention will be apparent in the summary and description of preferred embodiments, and will be readily apparent to those skilled in the art having knowledge of various roofing saddles, roofing crickets and/or related roofing designs, such objects, features, benefits and advantages will be apparent from the above as taken in conjunction with the accompanying examples, data, figures and all reasonably interferences to be drawn therefrom.

In part, the present invention is a modular drainage system which can have a plurality of roofing component pairs, with an elemental component and a wedge component in each pair. Each such component has a right triangular upper surface and a common edge therebetween, the common edge having a first terminus providing a supplementary angular arrangement between the components and a second terminus providing a complementary angular arrangement between the components. In various preferred embodiments, each component has a uniform thickness dimension; however, in various other embodiments, each component can have a tapered thickness dimension. Whether tapered or of uniform thickness, the component pairs can be used in conjunction with at least one base component aligned thereunder, such base component configured to cooperate with the component pairs to provide adequate roofing drainage.

The modular system of this invention can include two of the aforementioned elemental/wedge component pairs. Alignment of the pairs along a common edge in such a manner can allow for arrangement adjacent to and drainage away from a peripheral roofing parapet. Alternatively, one elemental/wedge component pair can be installed in and provide drainage away from a corner configuration. As mentioned above, one or more base components can be utilized with any number of component pairs to provide a proper slope on the roofing surface.

Other preferred embodiments of this modular invention include a first pyramidal subsystem having four elemental/wedge component pairs. The alignment of each pair one with another provides a first axial edge defined by contiguous elemental components, and a second axial edge defined by contiguous wedge components. Such a modular subsystem can further include a polygonal component configured for alignment with each wedge component along the second axial edge, providing a combined surface superimposable on an elemental component surface. Two pairs of elemental components can also be arranged with each pair aligned to provide a common hypotenuse for each component on the first axial edge. Inclusion of at least one intermediate component between each polygonal component and each elemental component provides a second pyramidal drainage subsystem. As discussed above, the first and second subsystems together with their respective components can be utilized in conjunction with one or more base components to provide a desired slope and resulting drainage.

Alternatively, the modular system can further include: 1) two pairs of wedge components, with each pair aligned to provide a common hypotenuse for the components on the second axial edge; and 2) two pairs of elemental components, with each pair aligned to provide a common hypotenuse for each component on the first axial edge. Inclusion of at least one intermediate component between each wedge component and each elemental component—with or without one or more base components—provides a third pyramidal subsystem.

In part, the present invention is also a roofing kit, including 1) at least one preformed 3-dimensional right triangular elemental component with an upper surface; 2) at least one preformed 3-dimensional wedge component having an upper surface, with each component configured for position adjacent an elemental component to provide a complementary angular arrangement therewith; and 3) at least one preformed 3-dimensional polygonal component having an upper surface configured for position adjacent a wedge component to provide a combined surface superimposable on an elemental surface. Placement and assembly of the components on a roofing surface provides for drainage along the resulting valley lines. In preferred embodiments, each elemental component surface has an acute angle between about 30° and about 60°.

Each kit component can have a uniform thickness dimension. Alternatively, each elemental, wedge and polygonal component can have a tapered thickness dimension, with one edge of each such component having a uniform thickness dimension. The kit of this dimension can further include an intermediate component having a tapered thickness dimension substantially equal to the uniform dimension edge of an element component. Regardless, each component or combination thereof can be used in conjunction with a uniform or tapered base component so as to provide the desired slope and rate of drainage.

The inventive kit can provide a corner drainage surface using a pair of elemental and wedge components positioned complementary one to another. Alternatively, the kit can provide a side roofing surface assembly, using the aforementioned pair of elemental and wedge components together with a second pair positioned adjacent thereto, The kit can further provide four elemental/wedge component pairs, with each pair positioned one to another to provide a supplementary angular arrangement between adjacent pairs. Likewise, as mentioned above, the kit of this invention can also include one or more base components, of uniform or tapered thickness, to provide the requisite slope and drainage.

In part, the present invention is also a pyramidal assembly of roofing components, including 1) an elemental component and wedge component pair, each component having a right triangular upper surface and a common edge therebetween with the common edge terminating to provide supplementary and complementary angular arrangements between components, such that an elemental/wedge component pair provides a pyramidal face; and 2) three additional elemental/component pairs, with each additional pair also providing a corresponding pyramidal face. Accordingly, the assembly has perpendicular first and second axial edges, the first axial edge defined by contiguous elemental components and the second axial edge defined by contiguous wedge components. Without restriction or limitation, preferred assembly embodiments can include adjacent components with unhinged common edges.

As described more fully above, the assembly of this invention can further include a polygonal component configured for alignment with each wedge component along the second axial edge to provide for a combined surface superimposable on the elemental component surface. Likewise, as discussed above, the assembly of this invention can also include two pairs of elemental components, with each pair aligned to provide a common hypotenuse along the first axial edge. Inclusion of at least one intermediate component between each polygonal and each elemental component provides a larger pyramidal assembly.

For more expansive roofing surfaces, the inventive assembly can further include 1) two pairs of wedge components, each aligned to provide a common hypotenuse on the second axial edge; 2) two pairs of elemental components aligned to provide a common hypotenuse on the first axial edge; and 3) at least one intermediate component between each additional wedge and elemental components. Likewise, as discussed above, such an expanded assembly can further include one or more base components, for use alone or in conjunction with tapered roofing insulation or a given structural slope.

BRIEF DESCRIPTION OF THE DRAWINGS

The foregoing and other objects, features, benefits and advantages of this invention will be apparent from the following drawings and accompanying description of several related preferred embodiments. The drawings are not necessarily to scale or dimensionally consistent from one to another, emphasis instead placed upon illustrating various selected aspects of the present invention.

DESCRIPTION OF PREFERRED EMBODIMENTS

Figure 1:
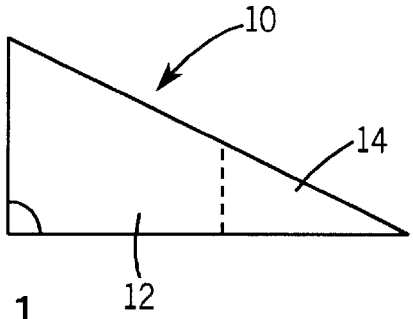
FIG. 1 is a top view of an elemental component, showing in phantom line the superimposability of associated wedge and polygonal components, in accordance with this invention.

With reference to FIG. 1, the roofing kits, assemblies and/or systems of the present invention include modular components having the configurational and angular relationships illustrated. In particular, elemental component 10 has an upper surface configuration which coincides with the placement of polygonal component 12 adjacent to wedge component 14. While elemental component 10 has a right angle, as shown, a second angle of wedge component 14 can be up to 60 degrees, while the opposite leg of elemental component 10 and the configuration of polygonal component 12 vary accordingly.

Figure 2:
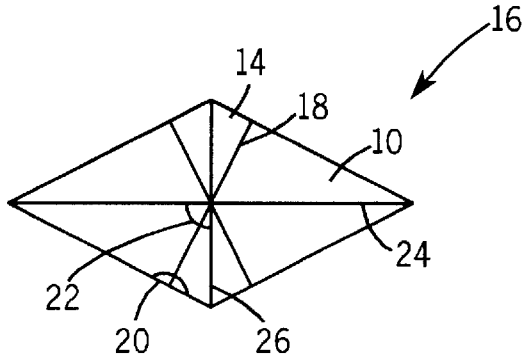
FIG. 2 is a top view of a modular pyramidal roofing system utilizing four pairs of elemental/wedge components.

As shown in FIG. 2, a combination of elemental and wedge components can be assembled to provide one or more drainage systems. Subsystem 16 comprises four such elemental/wedge component pairs. Each such pair provides common edge 18 between components. The common edge provides respective supplementary 20 and complementary 22 angular relationships between each component 10 and component 14. The alignment of each elemental/wedge component pair provides first axial edge 24 and second axial edge 26, such edges defining the four faces of a pyramidal configuration. As described elsewhere herein, each of elemental component 10 and wedge component 17 can have a vertically tapered thickness dimension, so as to provide a pyramidal configuration elevated at a vertex. Alternatively, each such component can have a constant thickness dimension, with the necessary elevation provided by one or more base components positioned thereunder.

While subsystem 16 is shown with four elemental/wedge component pairs, various other system configurations can be assembled to provide proper roofing drainage. For instance, one elemental/wedge component pair, such as that shown in the upper right quadrant of FIG. 2, aligned along common edge 18 and be installed in and provide for drainage away from a corner configuration. Alternatively, two elemental/wedge component pairs, such as those aligned along first axial edge 24 or along second axial edge 26, can be arranged adjacent to and for drainage away from a peripheral roofing facade.

Modular subsystem 16 (as shown by outline 30 in FIG. 3) can be expanded by alignment of polygonal components 12 with each wedge component 14 along second axial edge 26; and alignment of elemental components 10', as shown, on first axial edge 24. Inclusion of at least one intermediate component 32 between each polygonal component 12 and elemental component 10' provides a second pyramidal drainage subsystem 24.

Figure 4:
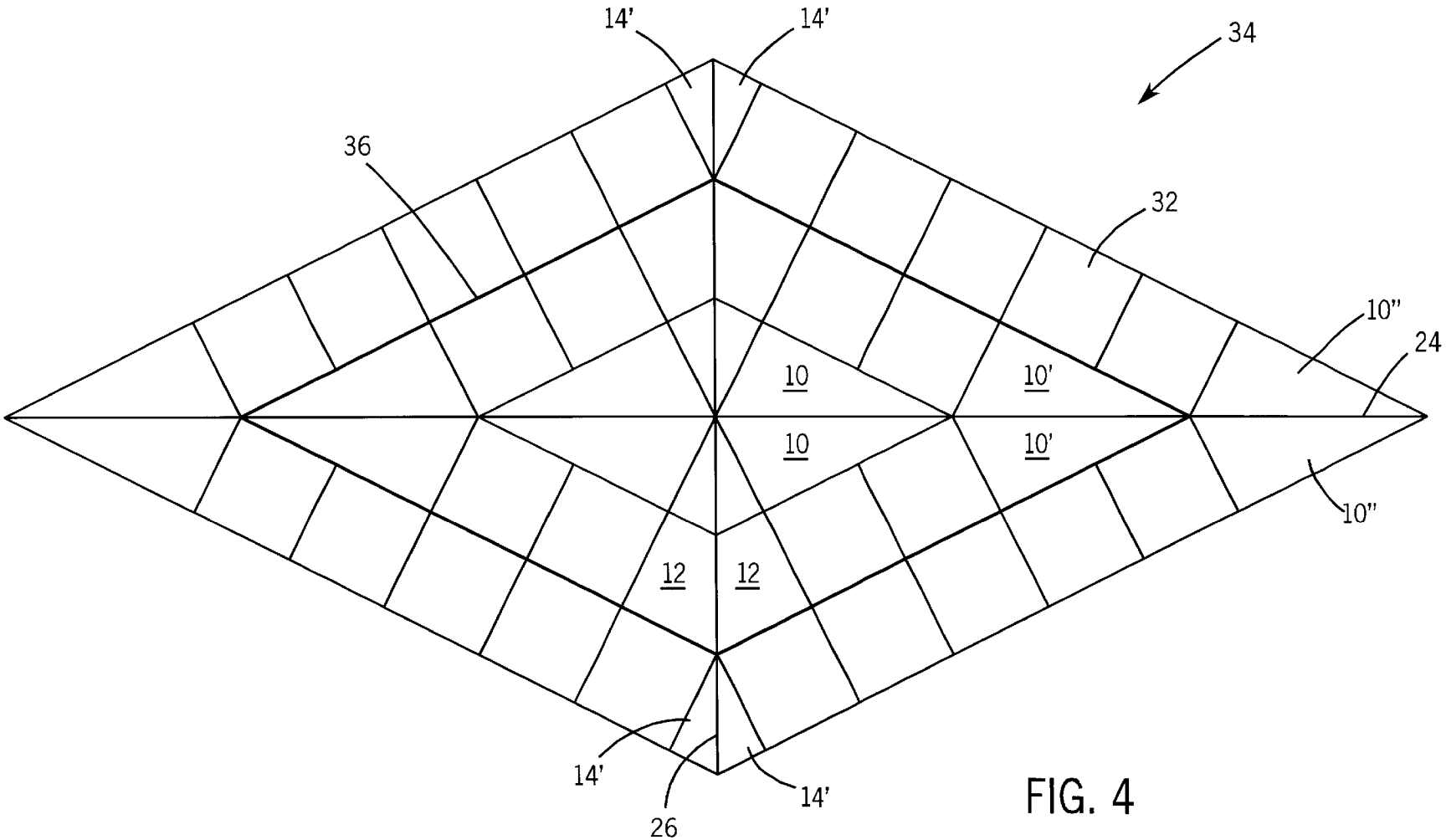
FIG. 4 is a top view of another modular pyramidal drainage/roofing system, in accordance with the present invention.

As shown in FIG. 4, subsystem 28 (as shown by outline 36) can be expanded with two pairs of wedge components 14' aligned along second axial edge 26, and placement of two pairs of elemental components 10" aligned, as shown, along first axial edge 24. Inclusion of at least one intermediate component 32 between each wedge component 14' and each elemental component 10" provides third pyramidal subsystem 34. As with other kits, alignments, configurations and/or assemblies of this invention subsystem 34 can include one or more base components to provide the desired elevation and tapered pitch.

Figure 5:
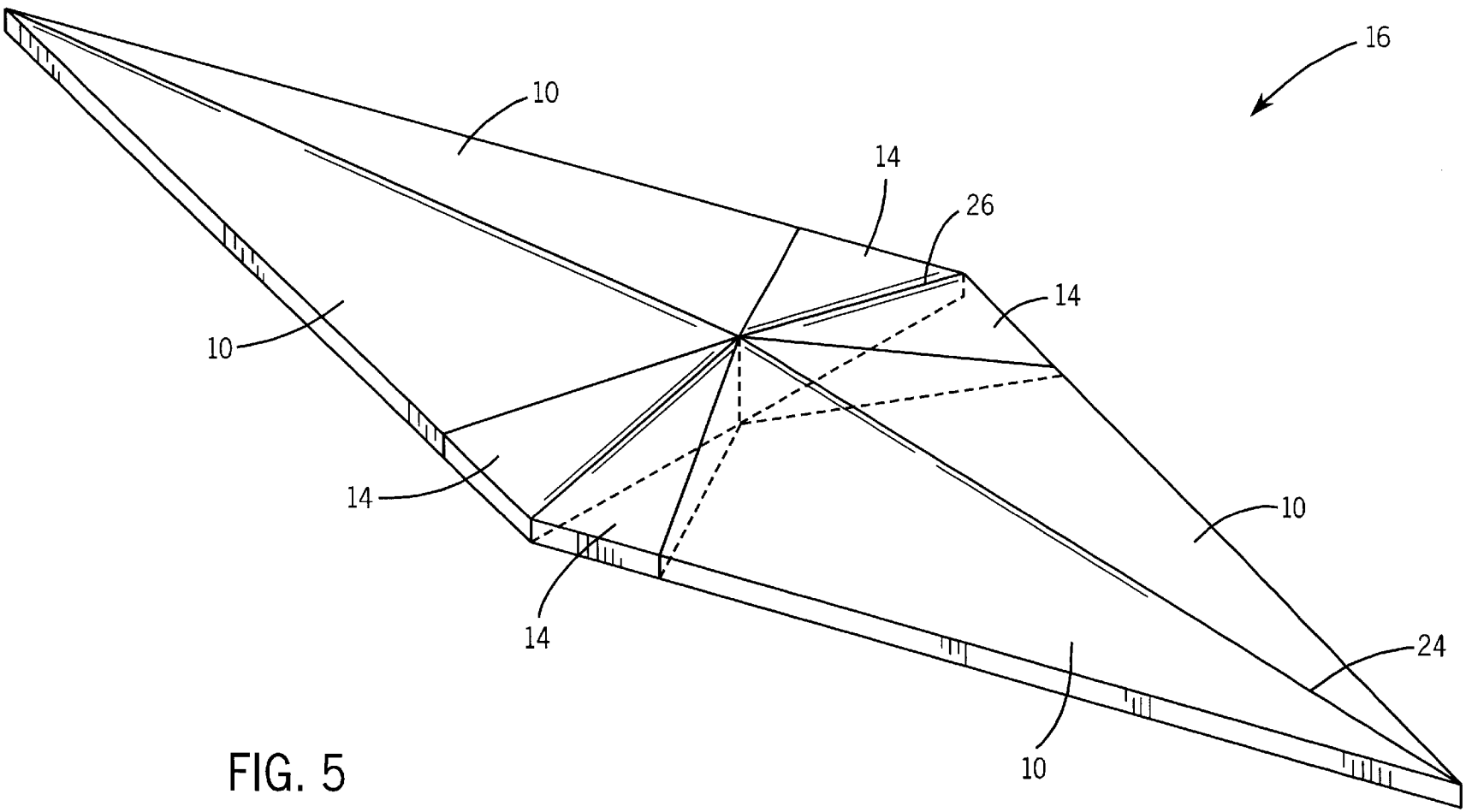
FIG. 5 is an elevated perspective view of a system of the sort illustrated in FIG. 2, in accordance with this invention, comprising vertically tapered components.
Figure 6:
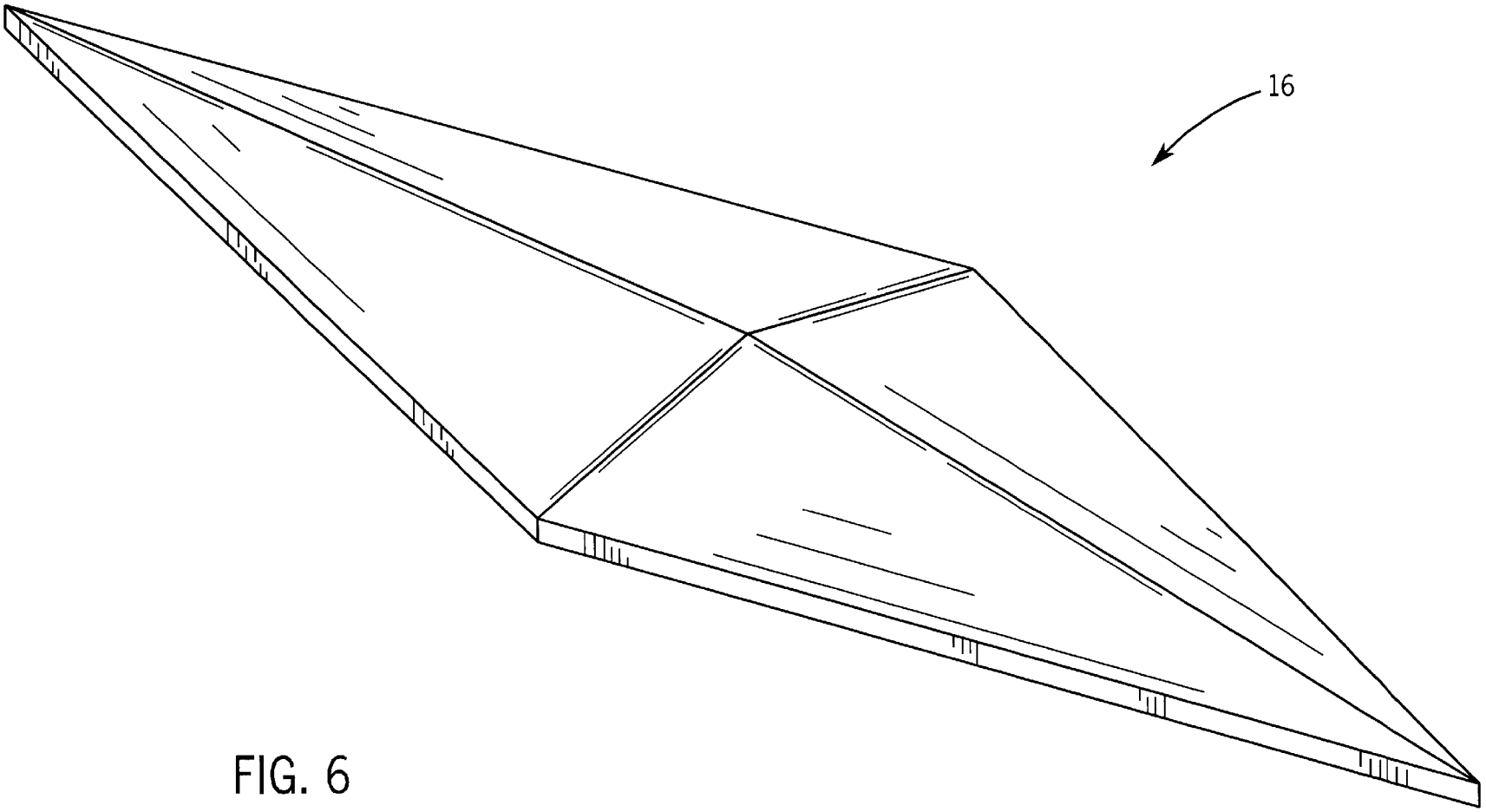
FIG. 6 is an elevated perspective view of the drainage system of FIG. 5 with a covering thereon.

The perspective of FIG. 5 shows the elevation at the vertex of a pyramidal subsystem of the type illustrated in FIG. 2. FIG. 6 shows the appearance of pyramidal subsystem 16, as illustrated in FIG. 2, with an applied covering. Covering applied over such a subsystem can be of any suitable type, such as single ply, built-up and/or modified bitumen membranes.

Figure 7:
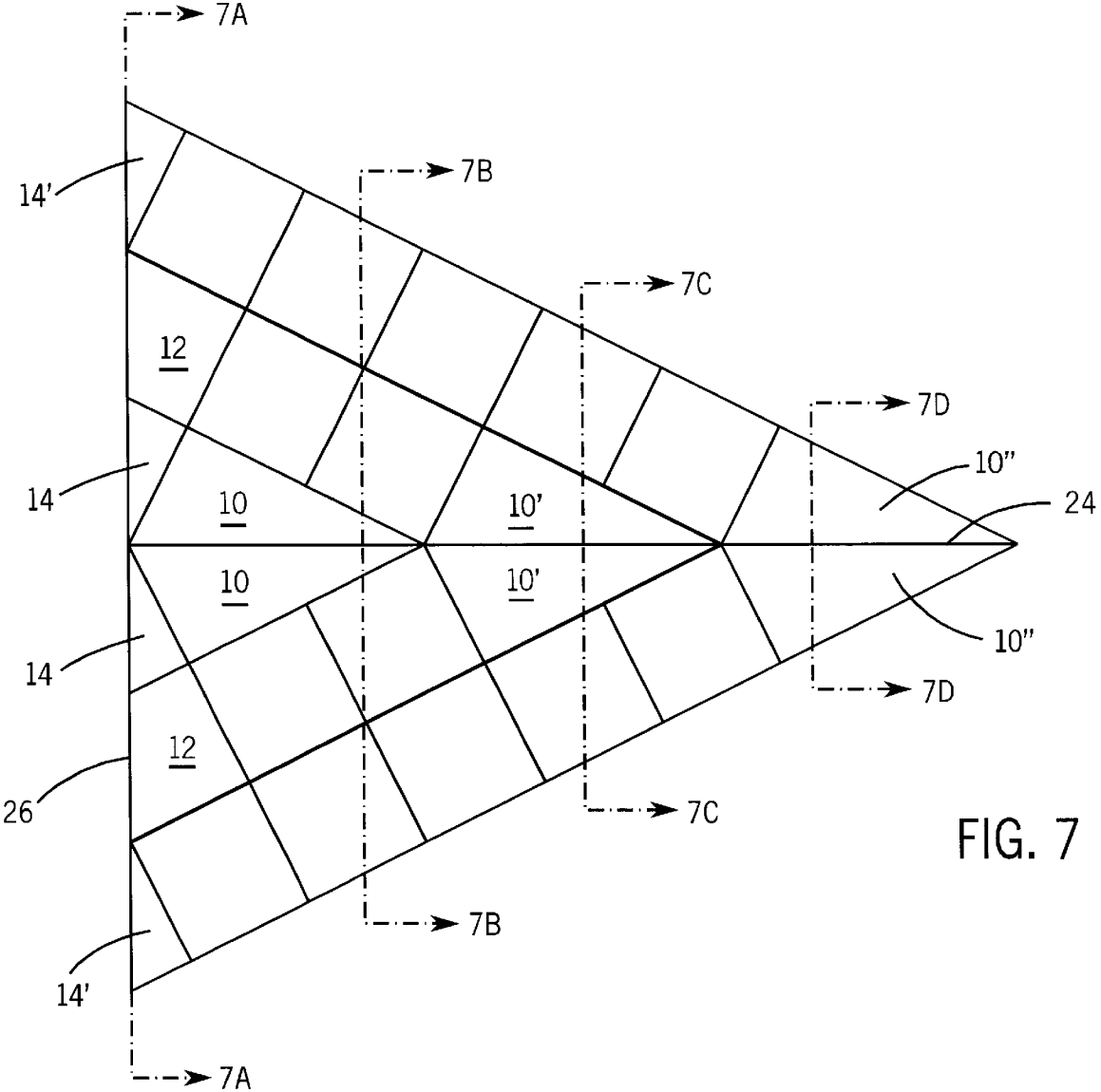
FIG. 7 is a partial top view of drainage/roofing system of the sort illustrated in FIG. 4.
Figures 7A, 7B, 7C, 7D:
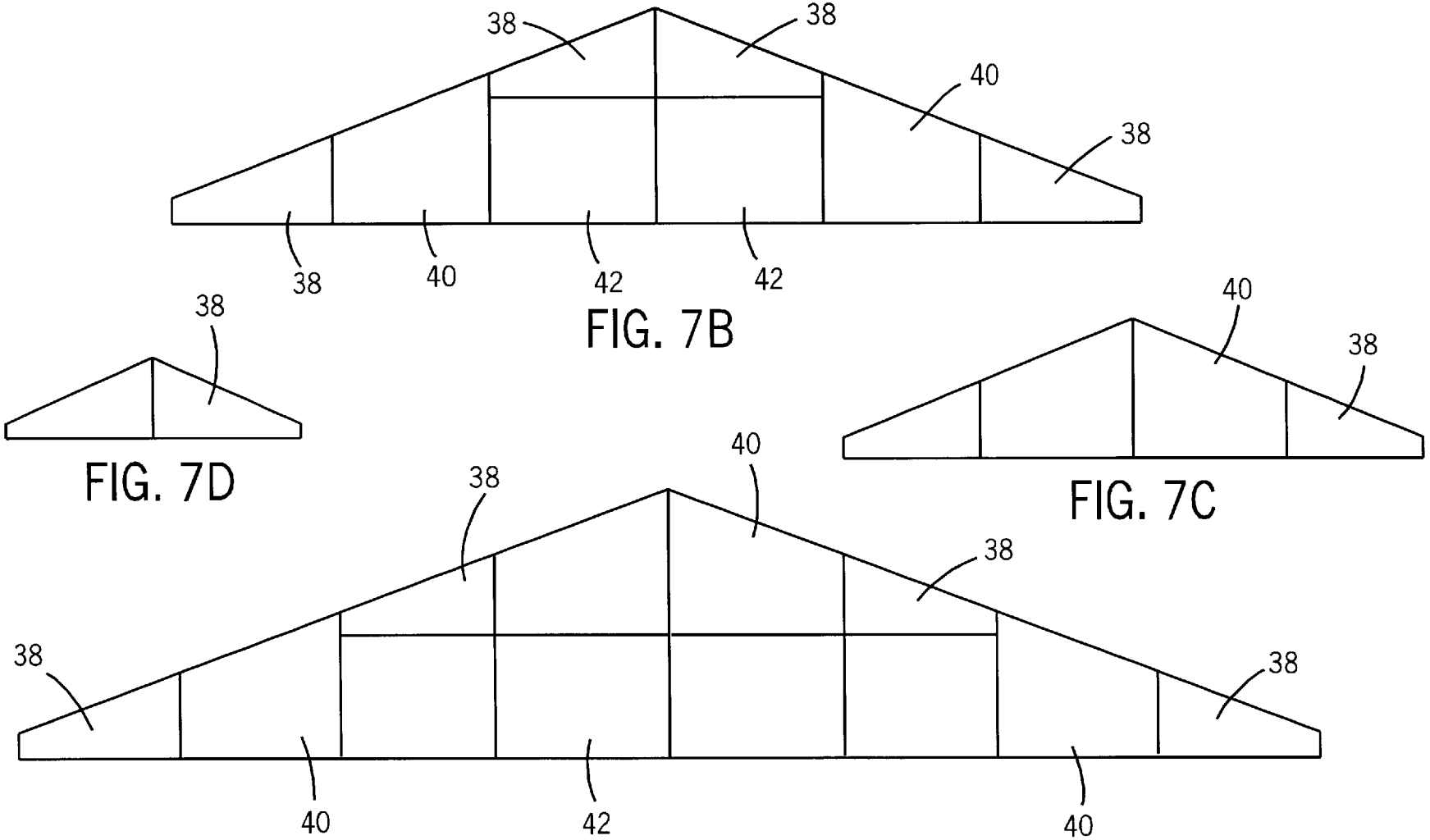
FIG. 7A is a sectional view of the system of FIG. 7 taken along line 7A—7A thereof.
FIG. 7B is a sectional view of the system of FIG. 7 taken along line 7B—7B thereof.
FIG. 7C is a sectional view of the system of FIG. 7 taken along line 7C—7C thereof.
FIG. 7D is a sectional view of the system of FIG. 7 taken along line 7D—7D thereof.
Figure 7E:
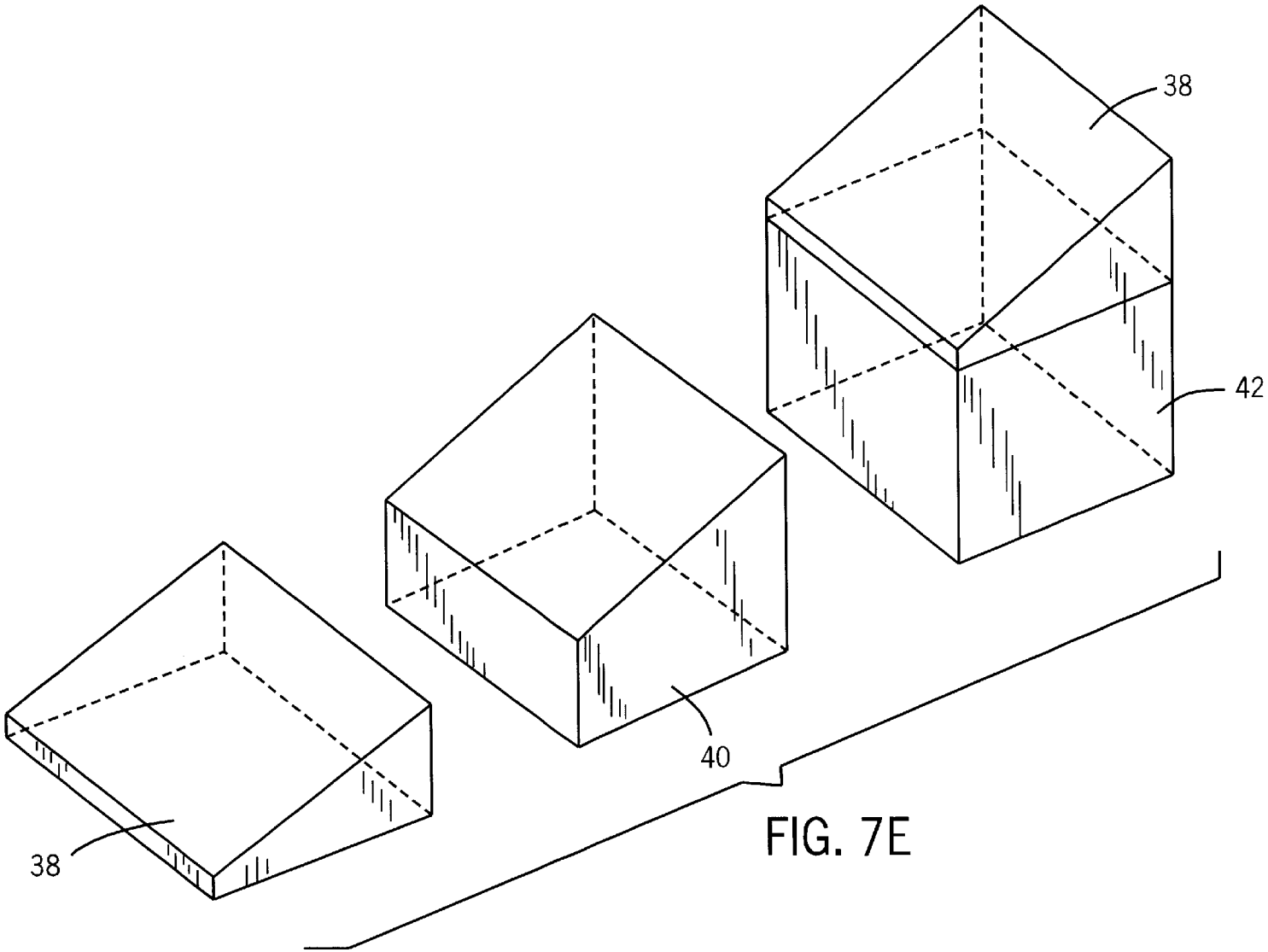
FIG. 7E is an exploded, partial view of several base components illustrated in FIG. 7C.
Figure 8:
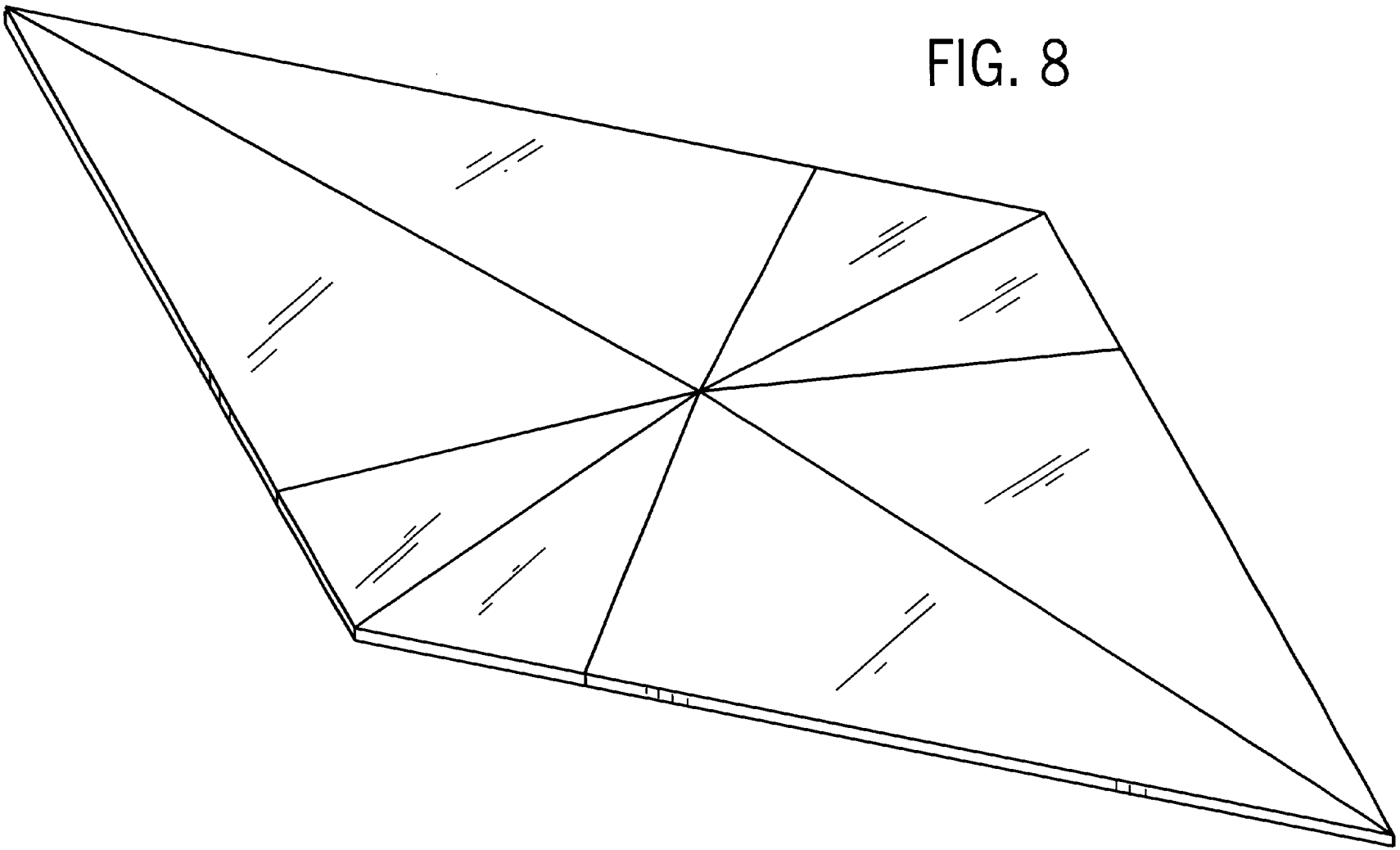
FIG. 8 is an elevated perspective view of a modular pyramidal roofing system, with four pairs of elemental/wedge components in preferred geometric and dimensional proportion.
Figure 9:
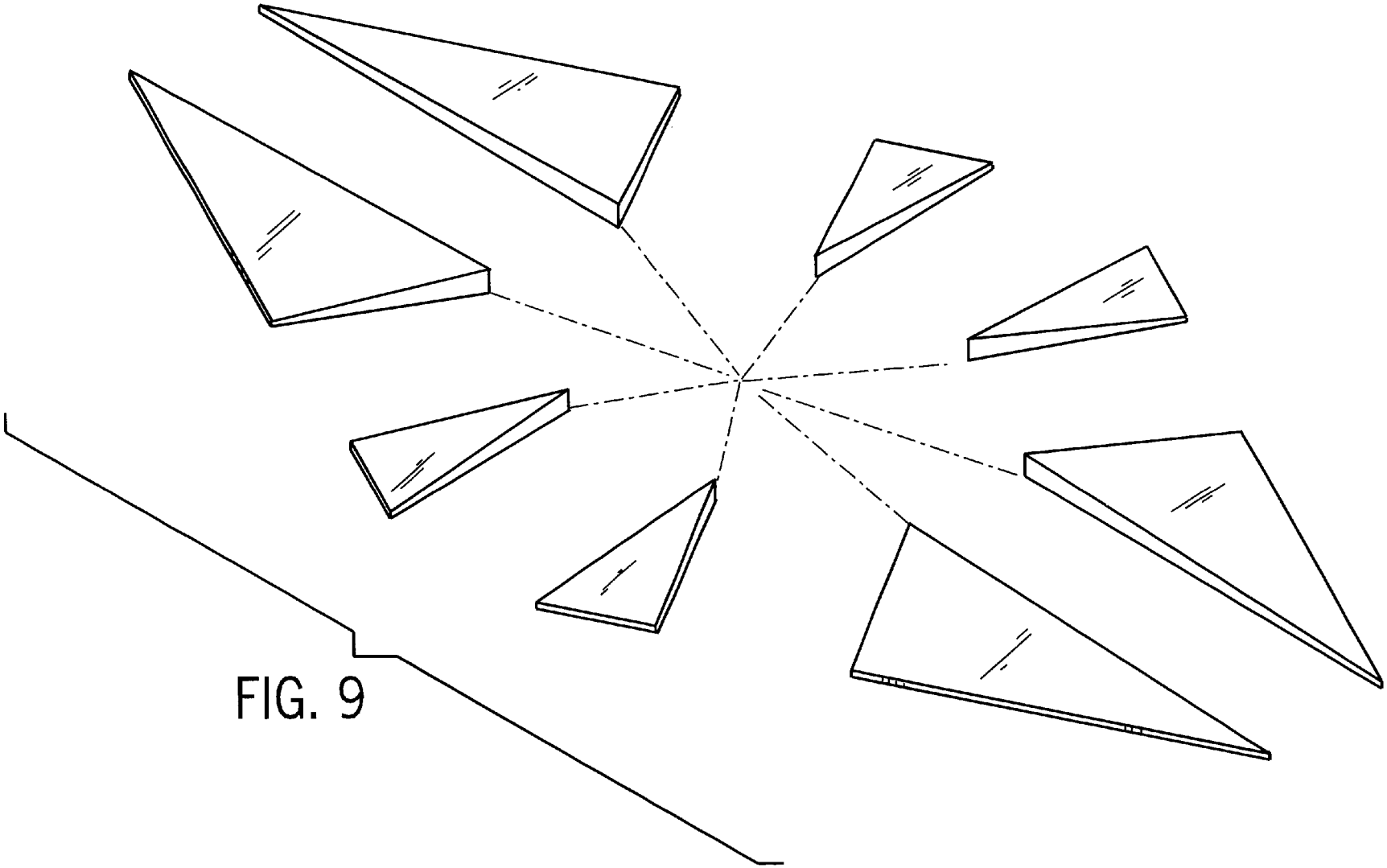
FIG. 9 is an exploded view of the components of the system of FIG. 8, showing, in particular, tapered thickness dimensions.
Figure 10:
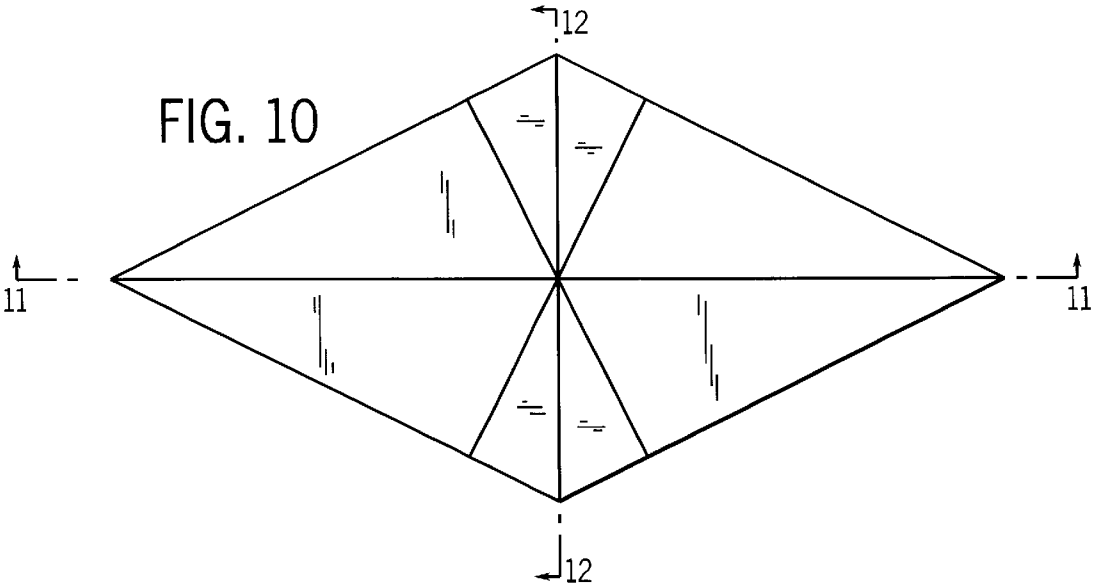
FIG. 10 is a top view of the system of FIG. 8.
Figure 11:
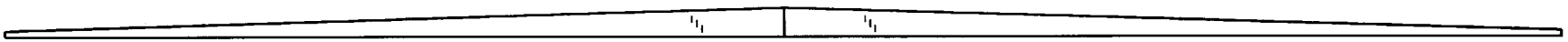
FIG. 11 is a sectional view of the system of FIG. 10 taken along with line 11—11 thereof.
Figure 12:
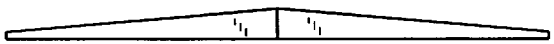
FIG. 12 is a sectional view of the system of FIG. 10 taken along line 12—12 thereof.

With reference to FIG. 6, a perspective view of the right side of such a subsystem is provided in FIG. 7. Assume, for the purpose of a limited discussion concerning one preferred embodiment, that each elemental, wedge, polygonal and intermediate component has a constant thickness dimension. As such, the necessary elevation to provide proper drainage can be provided by one or more base components positioned or assembled thereunder to provide a pyramidal geometry. FIGS. 7A–7D, taken along the corresponding lines of FIG. 7, show in succession representative cross-sectional dimensions and/or base components of the type which can be used in conjunction with the present invention. FIG. 7E provides a partial, exploded view of several base components of the type illustrated in FIG. 7B. Such base components are as described more fully in the aforementioned '883 patent, the corresponding text and figures of which are incorporated herein, in their entirety, by reference.

Hinges can be used, optionally, to connect adjacent components. Examples of flexible material that can be used for such hinges include adhesive tape, duct tape and the heavy felt facer used on polyisocyanurate foam board. Heavy felt can be glued with insoluble contact adhesive or a two-part thermosetting adhesive such as epoxy. The use of hot melt adhesive is not practical as it will dissolve in hot asphalt. Other flexible materials that can be used are heavy Kraft paper, plastic film or pseudo leather such as Naugahyde, leather, multi-substance synthetic fiber tapes, either woven or non-woven and composite tapes with or without adhesive pre-applied.

FIGS. 8–12 provide various views of a number of roofing systems, assemblies, components and/or kits in accordance with this invention. The illustrations are in proportion to a preferred embodiment and show the angular and dimensional relationships within and among the multiple components. In particular, FIGS. 9–12 show the components having a tapered thickness dimension, such as allows for their use without base components of the sort shown in FIGS. 7A–7D. With reference to FIGS. 9–12, it will be understood that this invention also provides for the systems, kits and/or assemblies of FIGS. 3 and 4 without base components, with the desired slope provided through use of components tapered and dimensioned in relation one to another, as appropriate for the desired configuration.

Figure 3:
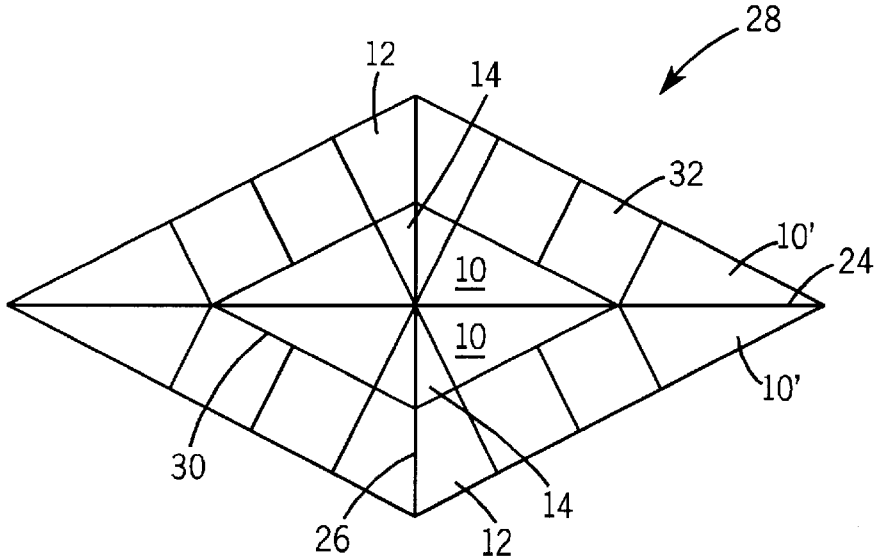
FIG. 3 is a top view of another pyramidal drainage/roofing system, in accordance with this invention.

In preferred embodiments of this invention, an assembly of components such as that shown in FIG. 2 is dimensioned 18 feet along a first pyramidal axis and 9 feet along a second axis perpendicular thereto. Such an assembly can accommodate drains arranged from about 12 feet to about 30 feet apart. Another preferred assembly of components is shown in FIG. 3 and can be dimensioned 36 feet along one axis and 18 feet along a second perpendicular axis, to accommodate roofing drains spaced from about 30 feet to about 48 feet apart. In proportion, a third preferred assembly such as that shown in FIG. 4 is dimensioned 54 feet along one axis and 27 feet along a second perpendicular axis, so as to accommodate drains spaced from about 48 feet to about 66 feet apart.

The components for each such system and/or assembly can be angled or dimensioned as otherwise described herein. However, a preferred elemental component utilizes a 30–60–90° triangular configuration, dimensioned with legs of 4 feet and 8 feet connected with a 9 foot hypotenuse. Alternatively, as another embodiment of this invention, a 45–45–90° triangular configuration can be utilized. However, the relative ease with which the latter assembly can be used is countered by more waste from a manufacturing standpoint. Regardless of the exact configuration of the elemental component, the corresponding wedge and polygonal components can be configured, accordingly, and prepared or as visualized through appropriate bisection of the elemental component. (Reference is made to FIG. 1.)

The components of the present invention can be formed from any suitable material, such as (for example), cellular glass insulation, rigid fiberglass insulation, cellulose fiber board, mineral fiber board, expanded polystyrene board, extruded polystyrene board, and laminated polyisocyanurate board. Various other material choices are available, and in accordance with this invention, as would be well-known to those skilled in the art and aware of the invention and any equivalent thereof. All kits, assemblies and/or modular drainage systems of the type described herein are available through Roofer's Mart of Wisconsin, Inc. of Wauwatosa, Wis.

EXAMPLES OF THE INVENTION

The following non-limiting examples and data illustrate various aspects, features and benefits relating to the modular kits, assemblies and/or systems of the present invention, including the surprising and unexpected ability of the present components when used as described above to improve drainage of water from flat roof surfaces. Comparable effects and advantages can be realized using various other embodiments, consistent with this invention.

Example 1

As a demonstration of the improved drainage capabilities available through this invention, a tapered roof configuration was simulated by placing one elemental and wedge component pair, sloped at one-quarter inch per foot on a wood surface sloped at one-eighth inch per foot. Per good roofing practice, a zero to one-half inch tapered edge piece was installed next to the elemental/wedge component pair, to provide a 22.5° angle and a minimum resultant slope of one-sixteenth inch per foot in the resulting valley line. The entire structure was covered with a standard waterproof roofing membrane. Five gallons of water was discharged ($T_0$=0) at a slow constant rate onto the simulated sloped roofing configuration. After complete discharge, a flow of water continued down the valley line toward the drainage end of the simulated sloped configuration. A broken flow of water marked the end of the drainage simulation. The time ($T_1$) for drainage was 4:28 minutes.

Example 2

The simulated roofing configuration of the preceding example was constructed using a saddle cricket of the prior art available from Atlas Roofing Corporation, under the Gemini trademark. For comparison purposes, the panel was modified (cut) as described in U.S. Pat. No. 5,966,883 so as to have a length of 9 feet. The corresponding width dimension was 3 feet. A tapered edge was installed next to the cricket, per good roofing practice. Five gallons of water was again discharged ($T_0$) at a slow, constant rate. By visual observation, the water moved more slowly as compared to the simulation of Example 1. At 4:45 minutes ($T_2$), up to one-half inch water was measured near the valley line. This simulated drainage was terminated a short time later upon interrupted, broken flow, with a considerable volume of standing water on the membrane surface.

While the principles of this invention have been described in connection with specific embodiments, it should be understood clearly that these descriptions, along with the chosen figures, examples and data, are made only by way of example and are not intended to limit the scope of this invention in any manner. The various kits, assemblies, systems and/or subsystems described herein can be modified by way of dimension and/or angle so as to be used with a desired roofing installment. Other advantages and features of this invention will become apparent from the following claims, with the scope thereof determined by the reasonable equivalents as understood by those skilled in the art.

It is claimed:

1. A modular drainage system, said system comprising:

a plurality of roofing component pairs, an elemental component and a wedge component in each said pair, each said component having a right triangular upper surface and a common edge therebetween, said common edge terminating to provide a supplementary angular arrangement between said components and said common edge further terminating to provide a complementary angular arrangement between said components.

2. The system of claim 1 wherein each said component has a uniform thickness dimension.

3. The system of claim 1 comprising two of said elemental and wedge component pairs.

4. The system of claim 1 further including at least one base component.

5. The system of claim 1 comprising four of said elemental and wedge component pairs, said pairs providing a first pyramidal drainage subsystem, the alignment of each pair one with another providing a first axial edge defined by contiguous elemental components and providing a second axial edge defined by contiguous wedge components.

6. The system of claim 5 further including a polygonal component configured for alignment with each said wedge component, said alignment along said second axial edge to provide for a combined surface superimposable on said elemental component surface.

7. The system of claim 6 further including two pairs of elemental components, the components of each said pair aligned to provide a common hypotenuse for each component, said hypotenuse on said first axial edge.

8. The system of claim 7 further including at least one intermediate component between said polygonal component and said elemental component to provide a second pyramidal subsystem.

9. The system of claim 8 further including at least one base component.

10. The system of claim 8 further including:

two pairs of wedge components, the components of each said pair aligned to provide a common hypotenuse for each said component, said hypotenuse on said second axial edge; and two pairs of elemental components, the components of each said pair aligned to provide a common hypotenuse for each component, said hypotenuse on said first axial edge.

11. The system of claim 10 further including at least one intermediate component between each said wedge component and each said elemental component, to provide a third pyramidal subsystem.

12. The system of claim 11 further including at least one base component.

13. A roofing component kit, comprising:

at least one preformed three-dimensional right triangular elemental component having an upper surface;

at least one preformed three-dimensional wedge component having an upper surface, each said wedge component configured for position adjacent one said elemental component to provide a complementary angular arrangement with said elemental component; and at least one preformed three-dimensional polygonal component having an upper surface, said polygonal component surface configured for position adjacent one said wedge component surface to provide a combined surface superimposable on said elemental component surface, whereby placement and assembly of said components on a roof provides a surface for movement of water therefrom.

14. The kit of claim 13 wherein said elemental component surface has an acute angle, said angle between about 30° and about 60°.

15. The kit of claim 13 wherein each said component has a tapered thickness dimension, with one edge of each said component having a uniform thickness dimension.

16. The kit of claim 15 comprising a first pair of elemental and wedge components, said elemental component and said wedge component positioned complementary one to another, providing a corner roofing surface assembly.

17. The kit of claim 16 wherein another pair of said elemental and wedge components is positioned adjacent to said first pair of components to provide a side roofing surface assembly.

18. The kit of claim 17 comprising four of said elemental and wedge component pairs, each said pair positioned one to another to provide a supplementary angular arrangement between adjacent pairs.

19. The kit of claim 15 wherein said polygonal component has one edge with a tapered thickness dimension substantially equal to said edge of said wedge component having said uniform thickness dimension.

20. The kit of claim 13 further including an intermediate component, said intermediate component having a tapered thickness dimension substantially equal to said edge of said elemental component having said uniform thickness dimension.

21. The kit of claim 13 further including at least one base component.

22. A pyramidal assembly of roofing components, comprising:

an elemental component and a wedge component pair, each said component having a right triangular upper surface and a common edge therebetween, said common edge terminating to provide a supplementary angular arrangement between said components, and common said edge terminating to provide a complementary angular arrangement between said components, said elemental and wedge component pair providing a pyramidal face; and three additional elemental and wedge component pairs, each said pair providing a pyramidal face, said assembly having a first axial edge defined by contiguous elemental components and having a second axial edge defined by contiguous wedge components, said second axial edge perpendicular to said first axial edge.

23. The assembly of claim 22 wherein said common edge is unhinged.

24. The assembly of claim 22 further including at least one base component.

25. The assembly of claim 22 further including a polygonal component configured for alignment with each said wedge component, said alignment along said second axial edge to provide for a combined surface superimposable on said elemental component surface.

26. The assembly of claim 25 further including a two pairs of elemental components, the components of each said pair aligned to provide a common hypotenuse for each component, said hypotenuse on said first axial edge.

27. The assembly of claim 26 further including at least one intermediate component between said polygonal component and said elemental component.

28. The assembly of claim 27 further including:

two pairs of wedge components, the components of each said pair aligned to provide a common hypotenuse for each said components, said hypotenuse on said second axial edge;

two pairs of elemental components, the components of each said pair aligned to provide a common hypotenuse for each said component, said hypotenuse on said first axial edge; and at least one intermediate component between each said wedge component and each said elemental component.

* * * * *